US008915367B2

(12) United States Patent
Lee et al.

(10) Patent No.: US 8,915,367 B2
(45) Date of Patent: Dec. 23, 2014

(54) LOADING CONTAINER FOR TRANSPORTING GLASS SUBSTRATE

(75) Inventors: BumRo Lee, ChungCheongNam-Do (KR); Seok-Woong Kim, ChungCheongNam-Do (KR); YoungTaek Kim, ChungCheongNam-Do (KR)

(73) Assignee: Samsung Corning Precision Materials Co., Ltd. (KR)

( * ) Notice: Subject to any disclaimer, the term of this patent is extended or adjusted under 35 U.S.C. 154(b) by 0 days.

(21) Appl. No.: 13/610,183

(22) Filed: Sep. 11, 2012

(65) Prior Publication Data

US 2014/0034537 A1 Feb. 6, 2014

(30) Foreign Application Priority Data

Aug. 3, 2012 (KR) ..... 10-2012-0085365

(51) Int. Cl.
*B65D 85/48* (2006.01)

(52) U.S. Cl.
USPC ..... 206/454; 220/812

(58) Field of Classification Search
USPC ..... 220/8, 4.32, 812; 206/454, 448; 211/41.14, 41.15, 41.16
See application file for complete search history.

(56) References Cited

U.S. PATENT DOCUMENTS

| | | | | |
|---|---|---|---|---|
| 404,558 | A * | 6/1889 | Preston | 220/4.21 |
| 2,943,899 | A * | 7/1960 | Beller | 312/3 |
| 6,446,397 | B1 * | 9/2002 | O'Connor et al. | 52/64 |
| 7,980,397 | B2 * | 7/2011 | Noda et al. | 211/41.14 |
| 2009/0243450 | A1 * | 10/2009 | Weng | 312/334.1 |
| 2012/0145718 | A1 * | 6/2012 | Quarry et al. | 220/507 |

* cited by examiner

*Primary Examiner* — Steven A. Reynolds
*Assistant Examiner* — Javier A Pagan
(74) *Attorney, Agent, or Firm* — Lerner, David, Littenberg, Krumholz & Mentlik, LLP

(57) ABSTRACT

A zipper-type loading container for transporting glass substrates in which an increased number of glass substrates can be loaded for transport, thereby increasing the convenience of workers. The loading container for transporting glass substrates includes a loading frame having a loading surface, which supports the lower end of the glass substrates, and a backing surface, which supports the rear surface of a batch of the glass substrates. A cover frame is provided on the loading frame, and slides on the loading frame in forward and backward directions of the loading frame, and cover the upper end and the sides of the glass substrates. A zipper-type opening/closing sheet is provided on the front portion of the cover frame, and opens and closes the front portion of the cover frame.

5 Claims, 7 Drawing Sheets

LOADING CONTAINER FOR TRANSPORTING GLASS SUBSTRATE

CROSS REFERENCE TO RELATED APPLICATION

The present application claims priority from Korean Patent Application Number 10-2012-0085365 filed on Aug. 3, 2012, the entire contents of which application are incorporated herein for all purposes by this reference.

BACKGROUND OF THE INVENTION

1. Field of the Invention

The present invention relates to a loading container, and more particularly, to a zipper-type loading container in which an increased number of glass substrates can be loaded for transport, thereby increasing the convenience of workers.

2. Description of Related Art

Recently, in response to the scaling up of display panels, loading containers are used as means for transporting glass substrates, which are used for display panels, in manufacturing lines. For this, in the related art, door-type loading containers have been operated in manufacturing lines. Such loading containers of the related art employ, for example, a triple-folding door.

However, the door-type loading containers of the related art have the following problems. When a loading container is opened, the folding door is located at sides, occupying a predetermined space on the right and left sides. The door then interferes with workers, thereby inconveniencing them. In addition, it is impossible to load glass substrates from the sides. The related art also has a problem in that the space inside the loading container is reduced because of the thickness of the door. This decreases the number of glass substrates for display panels that can be loaded into the loading container. In addition, since the front folding door of the related art is a triple-folding type, it is troublesome for a worker to fold and unfold the door when required.

Accordingly, the problems with the loading container of the related art are that the large glass substrates for display panels are difficult to load, pack and unload.

The information disclosed in this Background of the Invention section is only for the enhancement of understanding of the background of the invention, and should not be taken as an acknowledgment or any form of suggestion that this information forms a prior art that would already be known to a person skilled in the art.

BRIEF SUMMARY OF THE INVENTION

Various aspects of the present invention provide a zipper-type loading container for transporting glass substrates in which the glass substrates can be loaded not only from the front but also from the sides and an increased number of glass substrates can be loaded for transport, thereby increasing the convenience of workers.

In an aspect of the present invention, the loading container for transporting glass substrates includes a loading frame having a loading surface, which supports the lower end of the glass substrates, and a backing surface, which supports the rear surface of a batch of the glass substrates; a cover frame provided on the loading frame, the cover frame being slidable on the loading frame in forward and backward directions of the loading frame, and covering the upper end and sides of the glass substrates; and a zipper-type opening/closing sheet provided on the front portion of the cover frame. The opening/closing sheet opens and closes the front portion of the cover frame.

In an exemplary embodiment, the cover frame may slide backward to expose the loading surface, so that the glass substrates are loaded on the loading frame in a lateral direction of the loading frame.

In an exemplary embodiment, the loading container may further include a guiding device guiding the cover frame such that the cover frame slides in the forward and backward directions of the loading frame.

Here, the guiding device may include a rail provided on the loading frame and a bearing provided on the cover frame such that the bearing slides along the rail.

In an exemplary embodiment, the loading container may further include an impact-absorbing pad provided on at least one of the loading surface and the backing surface.

According to embodiments of the invention, since the opening/closing sheet is applied for opening and closing the loading container, in place of a door of the related art, the thickness of the structure for opening and closing the loading container is decreased. Thus, the space inside the loading container can be greater than that of a loading container of the related art that has the same size, thereby increasing the number of glass substrates that can be loaded therein.

In addition, the use of the zipper-type opening/closing sheet can increase the convenience of workers when packing and unpacking (or loading and unloading) the glass substrates.

Furthermore, according to embodiments of the invention, a front folding door, a damper, etc. are removed, thereby simplifying the design of the loading container and reducing its size.

In addition, since the loading process of the related art is applied without change, the efficiency of operation can be increased, and compatibility with loading containers of the related art is realized.

Moreover, according to embodiments of the invention, the quality of packing is increased, thereby improving customer satisfaction.

The methods and apparatuses of the present invention have other features and advantages which will be apparent from, or are set forth in greater detail in the accompanying drawings, which are incorporated herein, and in the following Detailed Description of the Invention, which together serve to explain certain principles of the present invention.

DETAILED DESCRIPTION OF THE INVENTION

Reference will now be made in detail to various embodiments of a loading container for transporting glass substrates according to the present invention, examples of which are illustrated in the accompanying drawings and described below, so that a person having ordinary skill in the art to which the present invention relates can easily put the present invention into practice.

In the following description of the present invention, detailed descriptions of known functions and components incorporated herein will be omitted when they may make the subject matter of the present invention unclear.

Figure 1:
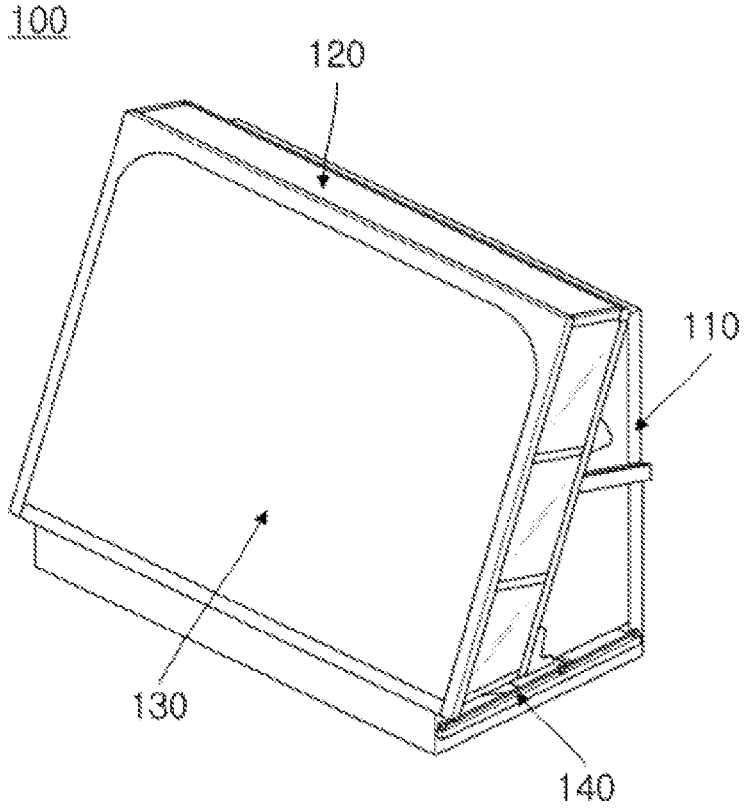
FIG. 1 is a perspective view showing a loading container for transporting glass substrates according to an exemplary embodiment of the invention.
Figure 2:
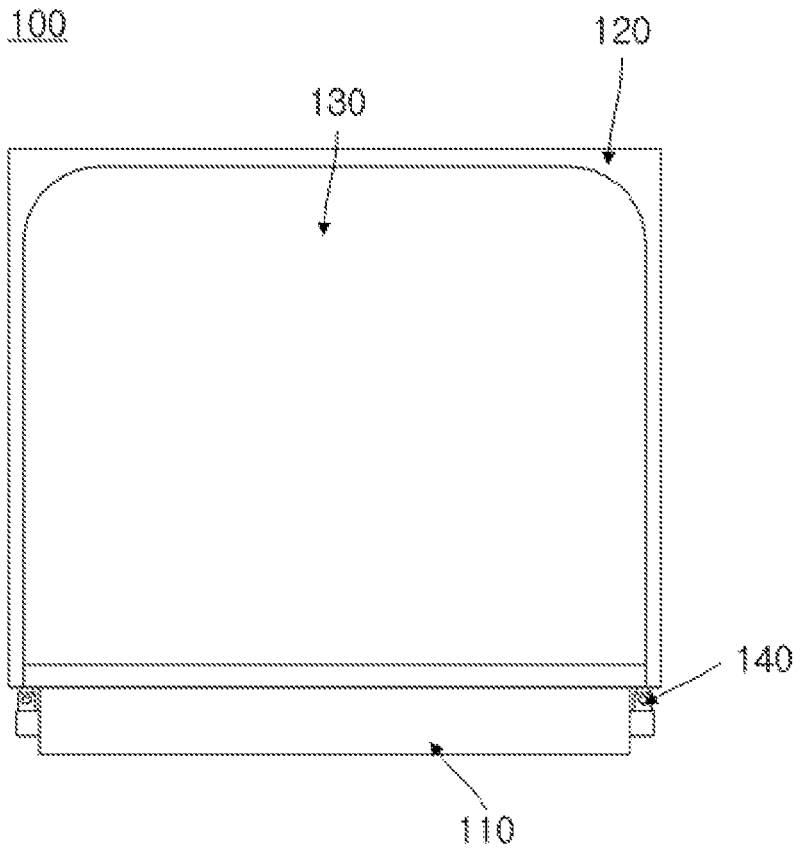
FIG. 2 is a front elevation view of the loading container shown in FIG. 1.
Figure 3:
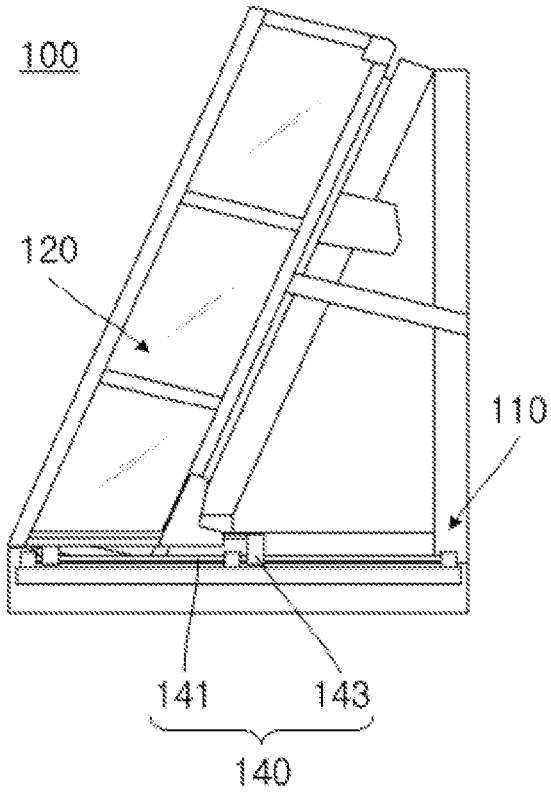
FIG. 3 is a side elevation view of the loading container shown in FIG. 1.
Figure 4:
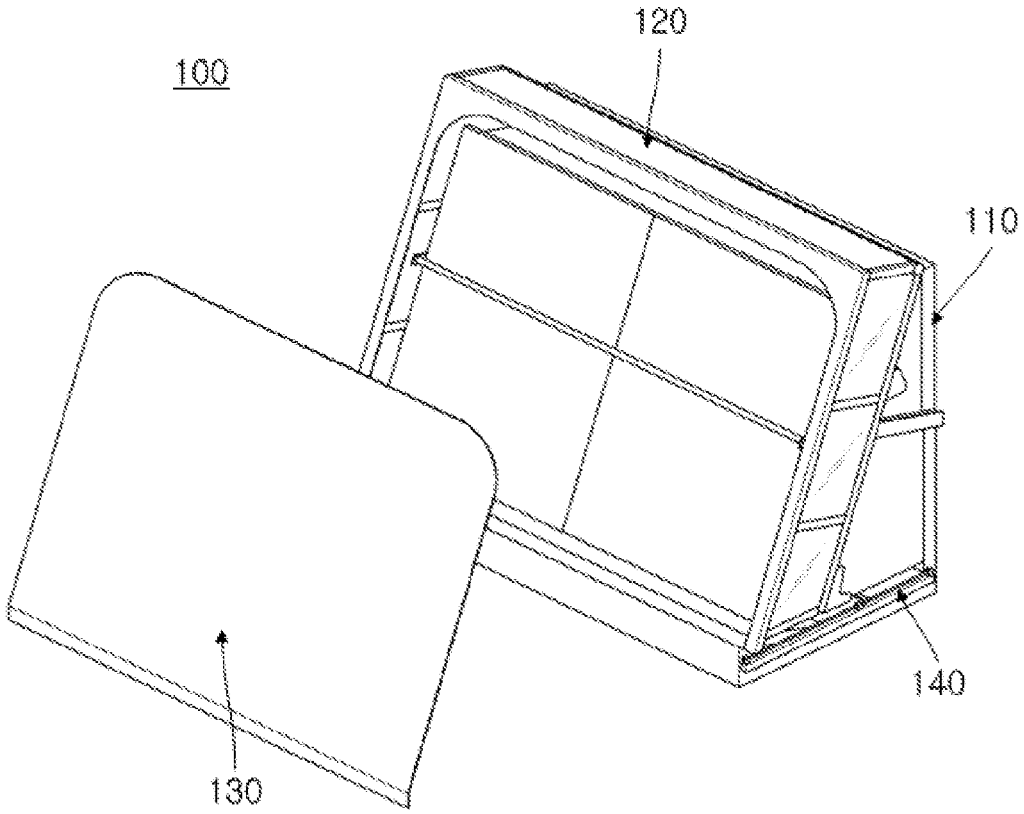
FIG. 4 is a schematic view showing the state in which glass substrates having been loaded into the loading container shown in FIG. 1.
Figure 5:
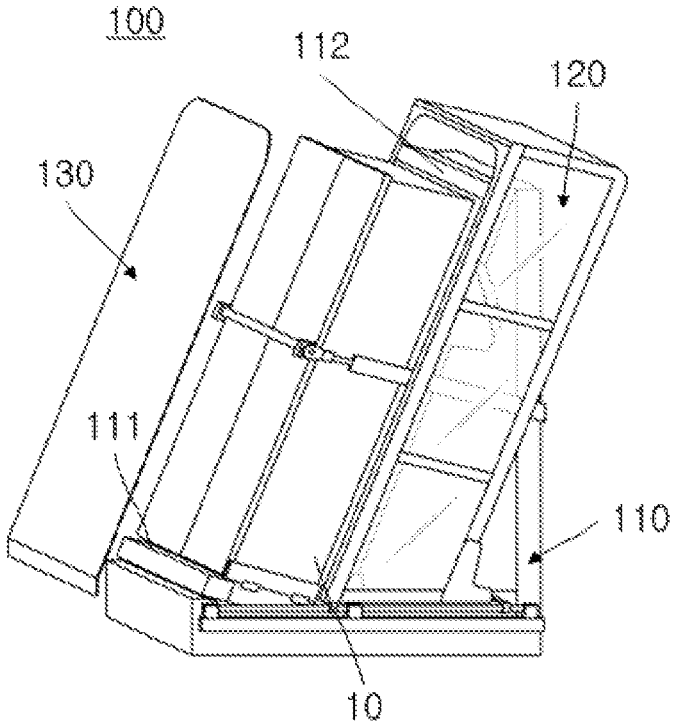
FIG. 5 is a schematic view showing the state in which an opening/closing sheet has been detached from the loading container shown in FIG. 1.
Figure 6:
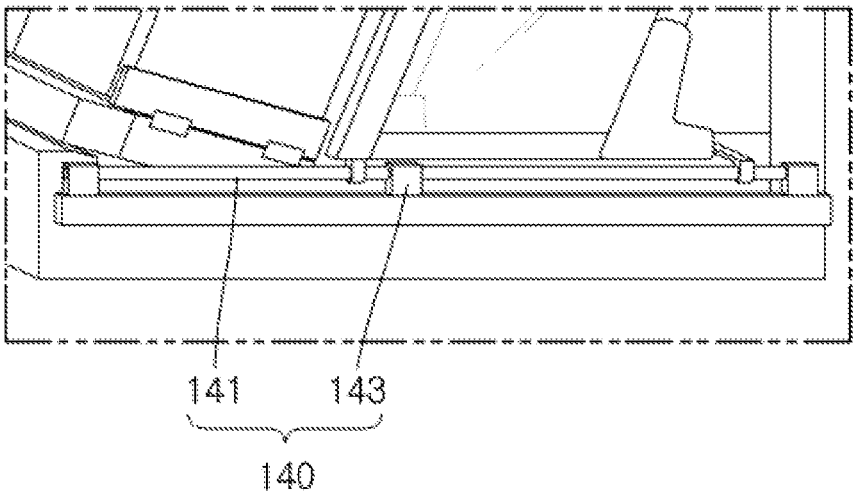
FIG. 6 is a partial enlarged view showing the guiding device of the loading container shown in FIG. 1.
Figure 7:
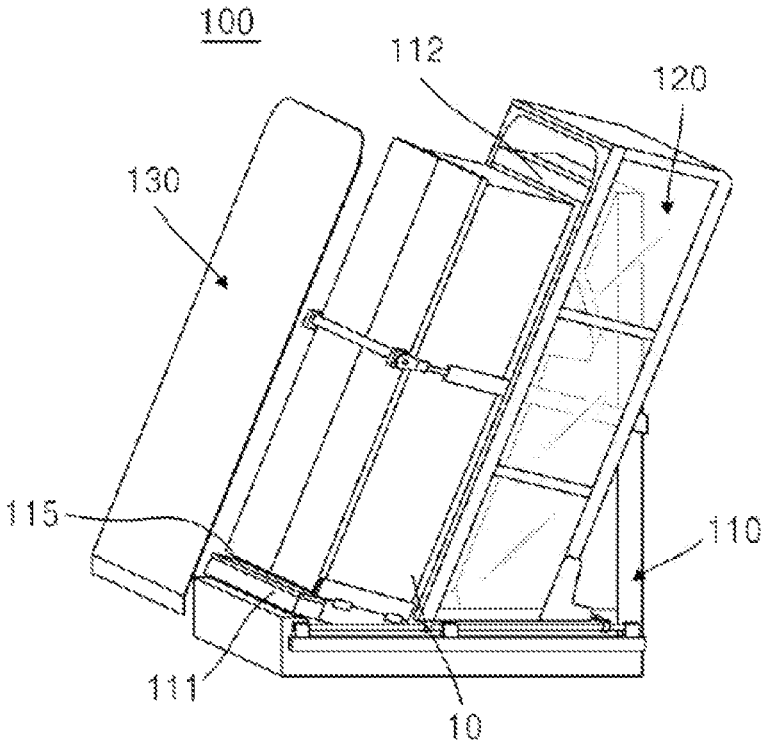
FIG. 7 is a schematic view showing the impact-absorbing pad of the loading container shown in FIG. 1.

Referring to FIG. 1 to FIG. 7, a loading container 100 for transporting glass substrates according to an exemplary embodiment of the invention is an apparatus that transports tens to hundreds of glass substrates 10, which are loaded and packed in the loading container 100. The glass substrates 10 are used in manufacturing lines for panels of display devices, such as liquid crystal displays (LCDs), plasma display panels (PDPs), organic light-emitting diodes (OLEDs) and touch-screen panels (TSPs). The loading container 100 includes a loading frame 110, a cover frame 120 and an opening/closing sheet 130.

The loading frame 110 forms the framework of the loading container 100, and defines a space on which glass substrates 10 are to be loaded. For this, the loading frame 110 has a loading surface 111, which supports the lower end of the glass substrates 10, and a backing surface 112, which supports the rear surface of a batch of the glass substrates 10. Here, the loading surface 111 is the upper surface of a lower frame, which forms a part of the loading frame 110, whereas the backing surface 112 is the front surface of a back frame, which forms a part of the loading frame 110. The lower frame and the back frame of the loading frame 110 may be fastened to each other using fastening means, or may be formed as a single integral frame. The side cross-section of the back frame may have the form of a right-angle triangle. The loading surface 111, which is the upper surface of the lower frame, may be inclined, such that it forms right angles with the tilted backing surface 112 of the back frame. Because the loading surface 111 and the backing surface 112 have this configuration, the glass substrates 10 are tilted at a predetermined angle when they are loaded in the container. In addition, the lower surface and the rear surface of a batch of the glass substrates 10 are completely abutted against the loading surface 111 and the backing surface 112, respectively. This configuration can prevent the glass substrates 10, which have a thin yet wide profile, from escaping from the loading container 100 due to impacts that are applied thereto during transportation or loading. This can also prevent a defect from occurring in the portion of the container on which the bottom of the glass substrates 10 is placed due to the weight of the glass substrates 10 being concentrated at the bottom thereof when the glass substrates 10 are vertically erected. That is, the inclined loading surface 111 and the tilted backing surface 112 are configured such that they are perpendicular to each other in order to ensure the stability of the glass substrates 10 when loading and transporting them.

An impact-absorbing pad 115 may be disposed on the loading surface 111 and/or the backing surface 112. The impact-absorbing pad 115 is provided in order to protect the glass substrates 10 from impacts that are applied thereto when the glass substrates 10 are being loaded, the loading container 100 is being moved, or the glass substrates 10 are being unloaded from the loading container 100. It is preferred that at least one impact-absorbing pad 115 be disposed on all or part of the area of the loading surface 111 and the backing surface 112.

The cover frame 120 covers the upper end and the sides of the glass substrates 10, while the loading frame 110 supports the bottom and the rear surface of the glass substrates 10. The cover frame 120 is disposed on the loading frame 110, such that the cover frame 120 can slide on the loading frame 110 in forward and backward directions of the loading frame 110. The aim of this configuration is to enable the glass substrates 10 to be loaded from the side of the loading frame 110. That is, when the glass substrates 10 are to be loaded, the cover frame 120 is slid backward so that the loading surface 111 of the loading frame 110 is exposed. Then, the glass substrates 10 can be loaded on the loading frame 110 in the lateral direction of the loading frame 110.

Here, the forward or backward sliding action of the cover frame 120 can be realized by a guiding device 140. The guiding device 140 guides the cover frame such that the cover frame slides to a predetermined position on the loading frame 110. The guiding device 140 enables the cover frame 120 to slide, using a variety of mechanisms. By way of example, the guiding device 140 may include rails 141 and bearings 143 in order to enable the cover frame 120 to slide. Here, the rails 141 may be provided on opposite edges of the loading frame 110 such that they extend in the direction in which the cover frame 120 is to slide, and the bearings 143 may be provided on the bottom of the cover frame 120 such that the rails 141 pass through the bearings 143 and the bearings 143 can slide along the rails 141. As an alternative, in place of the bearings, rollers which slide on rails may be provided on the bottom of the cover frame 120.

The opening/closing sheet 130 replaces a door of the related art, and is a zipper-type structure that is provided on the front portion of the cover frame 120. After all the glass substrates 10 are loaded on the loading frame 110 and then are covered by the cover frame 120 (which is, for example, slid forward to cover the sides of a batch of the glass substrates 10), the opening/closing sheet 130 covers the front portion of the cover frame 120. In addition, when the glass substrates 10 are to be unloaded from the loading container 100, the opening/closing sheet 130 opens the front portion of the cover frame 120, thereby exposing the glass substrates 10. When the zipper-type opening/closing sheet 130 as described above is used to open and close the front portion of the cover frame 120, the thickness of the opening/closing sheet 130 is less than that of the door of the related art, thereby enabling the space inside the loading container 100 to be greater than that of the loading container of the related art. Thus, the loading container 100 can contain more glass substrates 10 therein than a loading container of the related art that has the same size. In addition, since the zipper-type opening/closing sheet 130 is provided on the cover frame 120, it is easier for a worker to open and close the loading container. Preferably, a waterproof sheet can be used as the opening/closing sheet.

A description will be given below of the operation of the loading container according to an embodiment of the invention.

When loading the glass substrates 10 in the loading container for transport, first, the cover frame 120 is slid to the rear portion of the loading frame 110 by operating the guiding device 140. Then, the loading frame 110 is exposed. Then, the glass substrates 10 are pushed from the front or the side of the loading frame 110, so that they are supported by the loading surface 111 and the backing surface 112. Loading the glass substrate 10 in this fashion can increase the efficiency of loading. Afterwards, the cover frame 120 is slid to the front portion of the loading frame 110 by operating the guiding device 140, so that the upper end and the side of the glass substrates 10 are covered by the cover frame 120. Finally, the zipper of the opening/closing sheet 130 is closed, thereby completing the loading and packing of the glass substrates 10. As discussed above, the use of the thin opening/closing sheet can increase the space inside the loading container 100 such that it is greater than that of the door-type loading container of the related art. This can consequently increase the number of glass substrates 10 that can be loaded therein. When a waterproof sheet is used as the opening/closing sheet, it can preferably realize waterproofness. In addition, the application of the zipper structure to the opening/closing sheet 130 makes it easy to open and close the opening/closing sheet 130, thereby increasing the convenience of a worker. Accordingly, the opening/closing sheet 130 can improve the quality of the operation of packing the glass substrates 10 in the loading container 100, thereby increasing customer satisfaction. In addition, when unloading the glass substrates 10, which have been loaded in the loading container 100, the foregoing operation is performed in reverse order.

The foregoing descriptions of specific exemplary embodiments of the present invention have been presented with respect to the certain embodiments and drawings. They are not intended to be exhaustive or to limit the invention to the precise forms disclosed, and obviously many modifications and variations are possible for a person having ordinary skill in the art in light of the above teachings.

It is intended therefore that the scope of the invention not be limited to the foregoing embodiments, but be defined by the Claims appended hereto and their equivalents.

What is claimed is:

1. A loading container for transporting glass substrates, comprising:

a loading frame having a loading surface, which supports a lower end of the glass substrates, and a backing surface, which supports a rear surface of a batch of the glass substrates;

a cover frame provided on the loading frame, the cover frame being slidable on the loading frame in forward and backward directions of the loading frame, and covering an upper end and sides of the glass substrates;

a zipper-type opening/closing sheet provided on a front portion of the cover frame, the opening/closing sheet opening and closing the front portion of the cover frame; and wherein the cover frame is not detachable and adapted to slide backward until the rearmost part of the loading surface is exposed, so that the glass substrates all can be loaded on the loading frame in a lateral direction of the loading frame.

2. The loading container of claim 1, further comprising a guiding device guiding the cover frame such that the cover frame slides in the forward and backward directions of the loading frame.

3. The loading container of claim 2, wherein the guiding device comprises:

a rail provided on the loading frame; and a bearing provided on the cover frame such that the bearing slides along the rail.

4. The loading container of claim 1, further comprising an impact-absorbing pad provided on at least one of the loading surface and the backing surface.

5. The loading container of claim 1, wherein the zipper-type opening/closing sheet is a waterproof sheet.

* * * * *